United States Patent [19]

Ware

[11] 4,061,106

[45] Dec. 6, 1977

[54] RACING PADDLE AND METHOD OF MAKING THE SAME

[76] Inventor: Maximilian Ware, P.O. Box 147, Rapidan, Va. 22733

[21] Appl. No.: 742,424

[22] Filed: Nov. 17, 1976

[51] Int. Cl.[2] ..... B63H 16/04

[52] U.S. Cl. ..... 115/24.1; 416/74; 428/902

[58] Field of Search ..... 115/24.1, 21; 416/69, 416/70 R, 74, 230; 428/113, 367, 902; 156/184, 300, 309

[56] References Cited

U.S. PATENT DOCUMENTS 3,883,267 5/1975 Baudier et al. ..... 416/230

FOREIGN PATENT DOCUMENTS 405,488 12/1909 France ..... 115/21

2,424,016 11/1975 Germany ..... 115/24.1

1,339,719 12/1973 United Kingdom ..... 115/24.1

*Primary Examiner*—Barry L. Kelmachter

*Attorney, Agent, or Firm*—Oblon, Fisher, Spivak, McClelland & Maier

[57] ABSTRACT

An extremely light-weight racing paddle is disclosed which is formed of a very light-weight core of low structural strength surrounded by a shell formed of an extremely strong, light-weight fibrous material which supplies structural strength to the core material. The thickness of the fibrous material is varied along the shaft of the paddle so as to be thickest in the regions of highest stress. The blade of the paddle is reinforced by a selected pattern of fiber strips. Various embodiments of the basic paddle structure are disclosed, as is the method of making the paddle.

9 Claims, 7 Drawing Figures

RACING PADDLE AND METHOD OF MAKING THE SAME

BACKGROUND OF THE INVENTION

1. Field of the Invention

The present invention relates to paddles, and more particularly to an extremely light-weight racing paddle and a method of making the same.

2. Description of the Prior Art

In canoe racing, as in most racing sports, weight reduction is a factor of great significance. Minimizing the weight of a racing paddle is particularly significant since the paddle must be at all times supported entirely by the canoeist who, in the course of a canoe race, is subject to tremendous physical stress and fatigue. A weight reduction of even a few ounces may mean the difference between victory and defeat in a race where the paddle may be thrust into the water for several thousand strokes, each stroke utilizing an amount of energy determined in part by the weight of the paddle.

Furthermore, in canoe racing the paddle is used for both propelling the canoe and keeping it on course. To properly keep the canoe on course it is often necessary to move the paddle quickly from one side of the canoe to another. The speed of these motions together with the speed with which a paddle is withdrawn from the water at the end of a stroke and reinserted into the water to begin a new stroke is highly significant in any race since a fraction of a second delay in each movement of the paddle is multiplied by the thousands of paddle movements required to complete a race. Naturally, the weight of the paddle determines its momentum, and consequently determines the speed with which the paddle can be moved. Thus lightness of weight in the paddle is highly significant in maximizing the speed with which a racing paddle can be moved.

A need therefore exists for an extremely light-weight racing paddle, since such a paddle would clearly provide a significant competitive edge over other heavier paddles.

Naturally it is also necessary for a racing paddle to be rugged and reliable so that it has the strength to survive battering against rocks and the like which normally occurs in the course of a canoe race. Thus an ideal racing paddle must be light in weight while at the same time being strong and resistant to fracturing upon impact against rocks and the like.

SUMMARY OF THE INVENTION

Accordingly, one object of this invention is to provide a novel light-weight racing paddle structure.

Another object of the present invention is the provision of a novel, light-weight, high-strength racing paddle which is resistant to breakage upon impact against rocks or other hard objects.

A further object of the present invention is the provision of a novel paddle structure including a central core of light-weight and low structural strength surrounded by a fibrous material also of light-weight but having a very high structural strength.

Another object of the present invention is the provision of a novel method for constructing an extremely light-weight racing paddle.

A further object of the present invention is the provision of a novel method for producing an extremely reliable, structurally sound and light-weight racing paddle.

Briefly, these and other objects of the invention are achieved in accordance with the present invention by the provision of a novel paddle structure which includes a paddle core made of balsa wood or a similar material. The paddle core is extremely light in weight, but possesses very little structural strength. This core is coated to render it waterproof and subsequently reinforced by an outer sheath of extremely high-strength, light-weight filamentary carbon material which is resin coated for hardening. The shaft of the paddle is completely encased in the fibrous carbon material while the blade of the paddle is reinforced by strips of the fibrous carbon material placed on the blade in a pattern so as to provide maximum reinforcing strength with a minimum use of the carbon reinforcing material. The method of producing the paddle includes the steps of shaping and waterproofing the core and subsequently applying and hardening the fibrous carbon reinforcing material.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
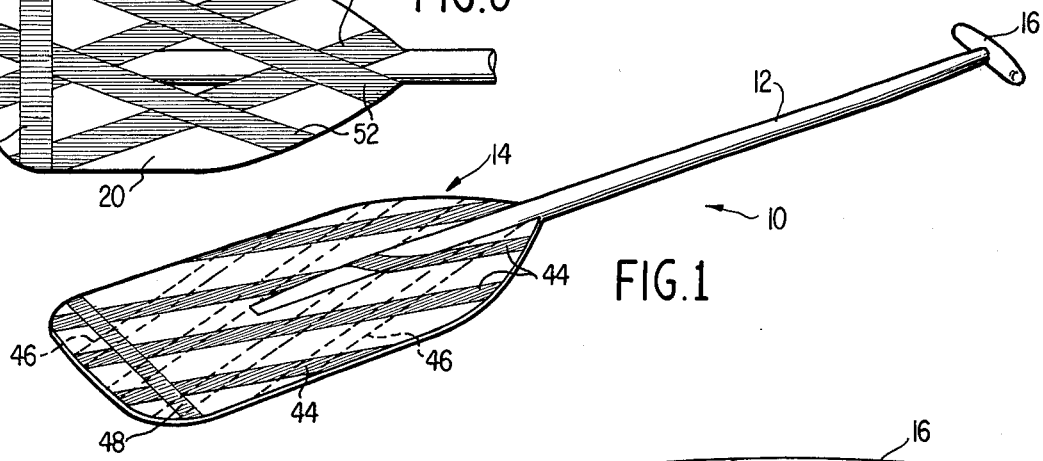
FIG. 1 is a perspective illustration of a first embodiment of a racing paddle constructed in accordance with the teachings of the present invention.

Referring now to the drawings, wherein like reference numerals designate identical or corresponding parts throughout the several views, and more particularly to FIG. 1 thereof, a first embodiment of the paddle of the present invention is referenced generally by the number 10. The paddle includes a shaft 12 having a blade 14 secured to the lower end thereof and a handle or grip 16 secured to the upper end thereof.

Figure 2:
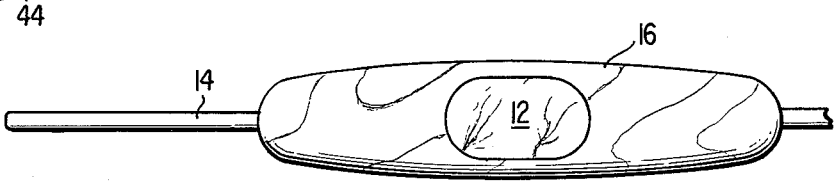
FIG. 2 is a top view of the shaft of the paddle illustrating its oval configuration and further illustrating in phantom the relationship between the handle of the paddle and the shaft.

As illustrated in FIG. 2, the shaft 12 of the paddle is generally oval in shape with the longer axis of the oval falling along the axis of the handle 16 and of the blade 14.

In constructing the paddle of the present invention, a very light-weight core material is used which provides the basic shape of the paddle. The strength of the core material is not essential in view of the high strength of the external shell that is applied to the core material. Thus, in contrast to most prior art paddle structures, the core material is selected primarily because of its light weight and because of the ease with which it may be shaped. Balsa wood is the preferred core material in accordance with the present invention, although other similar materials such as styrofoam plastic may also be used.

Figure 3:
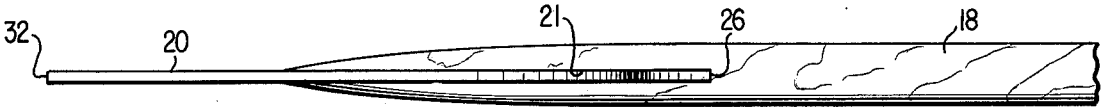
FIG. 3 is a partially cutaway side view illustrating the junction between the blade and shaft of the paddle.
Figure 5:
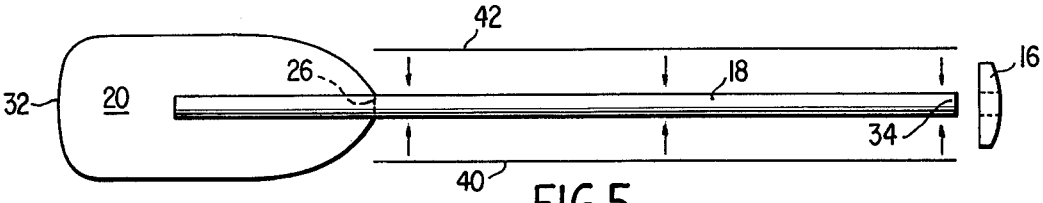
FIG. 5 is an exploded frontal view of the paddle further illustrating the manner in which reinforcing strips are fastened to the sides of the paddle core.

In constructing the panel, the core material is first formed into the desired shape by conventional techniques. For example, as shown in FIG. 5, a core shaft 18 and a core blade 20 are formed of the selected core material and are shaped in accordance with selected racing paddle design. The core shaft 18 is preferably provided with a slot 21, as shown in FIG. 3, into which the core blade 20 is fitted. The core blade 20 is then preferably cemented into place using an epoxy resin or other suitable glue to form a basic core panel structure, except that the grip 16 is not attached at this time.

Once the paddle core is fully assembled, it is coated with a suitable conventional resin material to waterproof it, and to provide both an incremental increase in the structural strength of the core and a foundation to which the subsequent shell layers are attached. The coated core is then permitted to dry and is lightly sanded to provide a smooth exterior surface. A second coating of resin is then applied to the entire core and, while this resin coating is wet, reinforcing fibers which form the exterior shell of the paddle are laid on as shown in FIGS. 4, 5, 6 and 1.

More specifically, the external fibers are in the form of tapes or tows comprised of graphite fiber composition having a very high stiffness to weight ratio. A conventional material of this type which is commercially available is identified as Fortafil (trademark) produced and sold by the Great Lakes Carbon Corporation. This material, as well as equivalent carbon filament materials of other manufacturers, produces an extraordinarily strong although light-weight structure when properly assembled and hardened by the use of the conventional resin hardening compositions familiar to those skilled in the art. However, in addition to the inherently desirable structural properties of this material, it must be properly applied to the previously described paddle core to produce a paddle structure of the optimum strength and mimimum weight. The technique of properly applying the fiber tows to the paddle core is initially illustrated in FIG. 4.

Figure 4:
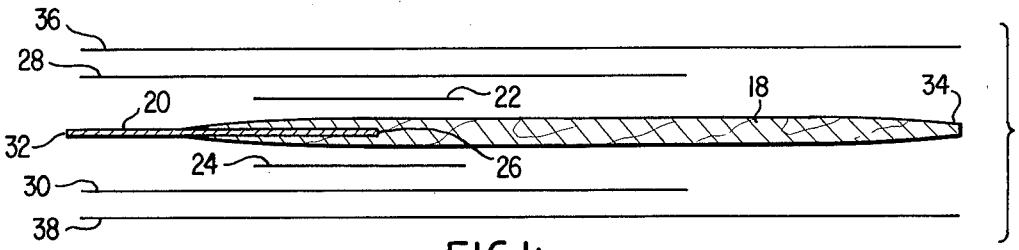
FIG. 4 is an exploded view illustrating how the layers of reinforcing material are placed over the core of the paddle.

Referring to FIG. 4, the assembled core shaft 18 and core blade 20 are shown in conjunction with a plurality of fiber tows of different length. Specifically, two short tows 22 and 24 are respectively positioned above and below the area at which the core blade 20 is secured to the core shaft 18. The two short tows are centered at approximately the upper end 26 of the core blade 20. This region is the region of maximum stress on the paddle when it is in use. Accordingly, the short tows 22 and 24 act as special reinforcements in the region of maximum stress. Each of the tows has a width such that when applied to the shaft 18 it may be wrapped halfway around the shaft so that the two tows together when placed on the shaft 18 surround the entire shaft. After the short tows 22 and 24 are positioned in place, they are coated with a suitable hardening resin.

Medium length tows 28 and 30 are subsequently placed on the shaft 18 and along the center line of the blade 20 over the short tows 22 and 24. Again, the tows 28 and 30 have a width sufficient so that when wrapped around the shaft 18, they surround the entire shaft. The medium tows 28 and 30 extend from the tip 32 of core blade 20 to a position on the shaft 18 which is approximately halfway between the end 26 of blade 20 and the end 34 of shaft 18. These medium length tows extend across the region of the paddle which is subject to the next highest degree of stress after the region covered by the short tows 22 and 24. Further, the medium tows 28 and 30 extend from the very tip of the core blade 20 to the middle of the shaft 18 thereby providing a continuous structural member uniting the shaft 18 and the blade 20 so that both members flex together as a single unit. The medium tows are also coated with a layer of hardening resin after being emplaced on the blade and shaft.

Finally, a pair of full length tows 36 and 38 are laid along the entire length of the combined core blade and shaft from the tip 32 of the blade to the end 34 of the shaft for uniting the entire structure with a continuous reinforcing member. This tow layer is also coated with a hardening resin after its emplacement along the core blade and shaft. Again, the full length tows also have a width such that when wrapped around the shaft and the previously emplaced tows, they together entirely surround the shaft 18.

The final reinforcement of the core shaft 18 is made, as shown in FIG. 5, by the addition of two side tows 40 and 42 which extend from the end 34 of shaft 18 to approximately the inner end 26 of the blade 20, although they may extend slightly further along the shaft 18. These side tows provide additional structural strength and rigidity to the shaft 18 and also seal the overlapping side edges of the tows applied as shown in FIG. 4. The tows 40 and 42 are also coated with a hardening resin.

Attention is again directed to FIG. 1 wherein one technique of reinforcing the core blade 20 is illustrated. Specifically, a plurality of angled tows 44 are laid across the upper surface of the core blade 20, as shown. The angled tows are shown to be separated by a distance which is approximately equal to the width of the individual tows. As indicated by the dashed lines 46, a similar plurality of fiber tows is positioned on the rear side of the core blade 20, but is angled in the opposite direction of the tows 44. This arrangement adds a uniform structural strength to the entire surface of the paddle blade and eliminates the possibility that the paddle blade might crack along a line parallel to the tows 44. A final tow 48 is wrapped around the surface of the blade 14 near the lower extremity thereof after the above-described tows are emplaced and is coated with a hardening resin to protect the tip of the completed paddle blade 14 against breakage due to impacts against rocks and other hard objects, as may occur in the course of a canoe race.

After all of the carbon filament tows are emplaced and the various resin coatings have had sufficient time to harden, the handle 16 is fitted over the end 34 of the shaft 18 which has now been reinforced by the carbon filament tows, and is epoxied in place to complete the paddle structure. Finishing of the paddle may subsequently be carried out to smooth the paddle surface. Similarly, the surface of the paddle may be treated by painting or other conventional techniques to improve its esthetic appearance. The completed paddle, which may vary in length between 50 and 64 inches, weighs only 16 to 19 ounches (vs. 28 ounces for the lightest known previously available paddle), providing a remarkable weight reduction of more than 40% over prior art paddles. Furthermore, the paddle of the present invention can support over 160 lbs. of pressure and is accordingly equally as strong as most other conventional racing paddles.

Figure 6:
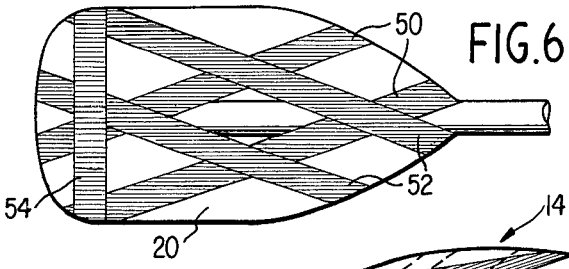
FIG. 6 illustrates an alternative configuration for reinforcing strips on the paddle blade.
Figure 7:
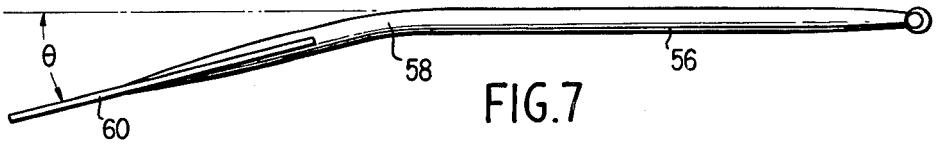
FIG. 7 illustrates a bent shaft paddle structure designed for marathon racing.

Alternate embodiments of the invention are illustrated in FIGS. 6 and 7. Referring particularly to FIG. 6, an alternative pattern is shown for reinforcing the paddle blade. Specifically, a first pair of parallel tows 50 is shown angled from left to right across the face of the core blade 20, while a second pair of parallel tows 52 is shown oppositely angled across the face of the core blade 20. This arrangement provides a reinforcing strip configuration in the form of a pair of "X's". The same pattern is repeated on the rear surface of the paddle in exactly the same form. An additional tow 54 is again wrapped around the tip of the paddle blade 20 to prevent breakage or chipping due to impacting of the paddle on rocks or other hard objects. The reinforcing configuration of FIG. 6 strengthens the paddle blade in a somewhat less symmetrical fashion than the pattern illustrated in FIG. 1, but results in a very firm and rigid paddle structure.

FIG. 7 illustrates a marathon paddle structure having a shaft 56 which is bent at 58 so that the paddle blade 60 forms an angle relative to the upper portion of the shaft 56. This paddle structure is formed by initially bending or cutting a shaft of the type illustrated in FIGS. 4 and 5 to form the proper angle between the paddle blade and shaft. Once the core structure is properly bent, the reinforcing fiber tows are applied in the same manner as described above and are hardened using conventional resin techniques as previously described.

The angle between the blade and shaft conventionally varies from between 5° and 15° depending upon preference. The bent paddle provides the most powerful thrust when the paddle is adjacent to the paddler, as opposed to providing maximum thrust at the beginning of the stroke when the paddler is reaching, or at the end of the stroke when the velocity of the blade through the water is diminishing. Since, under ideal conditions, all thrusting motion should be in a plane parallel to the surface of the water to provide maximum forward motion, the bent shaft paddle provides a more efficient means of transferring muscle energy to the water. However, steering and maneuvering are somewhat more difficult with the bent shaft paddle.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An extremely light-weight racing paddle comprising:

a core shaft formed of a very light-weight, easily shaped material, a core blade, also formed of a very light-weight and easily shaped material, secured to said core shaft, to form a paddle core structure, an external shell formed of hardened light-weight filamentary material molded around and bonded to said core shaft for providing an external structural reinforcement thereof, said external shell including continuous layers of said hardened light-weight filamentary material which overlap said core shaft and said core blade; and, a pattern of reinforcing strips of hardened light-weight filamentary material bonded to said core blade for providing an external structural reinforcement thereof, whereby an extremely light-weight, high-strength racing paddle is formed in the shape of said light-weight paddle core structure.

2. A paddle as in claim 1, wherein said continuous layers of said hardened light-weight filamentary material comprise:

a first layer extending across the area in which said core blade is secured to said core shaft, a second layer extending from one end of said core blade to approximately a mid point of said core shaft; and, a third layer extending from said one end of said core blade along the entire length of said core shaft, whereby continuous reinforcing members unite said core blade and core shaft into a unitary paddle structure.

3. A paddle as in claim 1, wherein:

said pattern of reinforcing strips includes a first plurality of angled reinforcing strips on one surface of said core blade and a second plurality of oppositely angled reinforcing strips on the other surface of said core blade.

4. A paddle as in claim 1, wherein:

said pattern of reinforcing strips includes a plurality of angled reinforcing strips forming X-shaped patterns on both surfaces of said core blade.

5. A paddle as in claim 2, further comprising:

a grip secured to said core shaft over said third layer of filamentary material.

6. A paddle as in claim 1, wherein:

said core shaft is bent near said core blade whereby said blade is oriented at an angle with respect to the main portion of said shaft.

7. A paddle as in claim 2, further comprising:

a reinforcing strip wrapped around said core blade near the tip thereof.

8. A method of making an extremely light-weight racing paddle, comprising the steps of:

forming a core shaft of a very light-weight material, forming a core blade of a very light-weight material, securing said core blade to said core shaft to form a core paddle structure, coating said core paddle structure with a layer of resin for waterproofing said core, sequentially applying carbon fiber tows along said core shaft and said core blade to form an external shell such that said carbon fiber tows overlap said core shaft and said core blade, and coating said carbon fiber tows with hardening resin.

9. A method as in claim 8, further comprising the steps of:

reinforcing said core blade with carbon fiber tows laid in an angular pattern; and, securing a grip to one end of said core shaft.

* * * * *